US011274438B2

(12) United States Patent
Shields

(10) Patent No.: US 11,274,438 B2
(45) Date of Patent: Mar. 15, 2022

(54) MOBILE INSULATION SYSTEM

(71) Applicant: SELECT ENGINEERING SERVICES, Layton, UT (US)

(72) Inventor: David Eugene Shields, Layton, UT (US)

(73) Assignee: SELECT ENGINEERING SERVICES, Layton, UT (US)

( * ) Notice: Subject to any disclaimer, the term of this patent is extended or adjusted under 35 U.S.C. 154(b) by 0 days.

(21) Appl. No.: 17/023,050

(22) Filed: Sep. 16, 2020

(65) Prior Publication Data

US 2021/0180317 A1 Jun. 17, 2021

Related U.S. Application Data

(60) Provisional application No. 62/902,477, filed on Sep. 19, 2019.

(51) Int. Cl.

| | |
|---|---|
| ***E04B 1/12*** | (2006.01) |
| ***E04B 1/76*** | (2006.01) |
| ***E04H 1/12*** | (2006.01) |
| ***E04B 1/80*** | (2006.01) |
| ***E04B 1/92*** | (2006.01) |
| ***E04F 13/00*** | (2006.01) |
| ***F41H 5/24*** | (2006.01) |
| ***E04B 1/86*** | (2006.01) |

(52) U.S. Cl.

CPC ..... *E04B 1/762* (2013.01); *E04B 1/80* (2013.01); *E04B 1/86* (2013.01); *E04B 1/92* (2013.01); *E04F 13/002* (2013.01); *E04H 1/1205* (2013.01); *F41H 5/24* (2013.01); *E04H 2001/1283* (2013.01)

(58) Field of Classification Search

None

See application file for complete search history.

(56) References Cited

U.S. PATENT DOCUMENTS 5,105,970 A * 4/1992 Malone ..... B65D 90/06 206/523
5,393,462 A * 2/1995 Avery ..... A61F 7/02 252/71
5,488,746 A * 2/1996 Hudson ..... A47C 27/007 5/500
5,582,028 A * 12/1996 Rilling ..... A45C 7/0095 62/457.4
6,237,171 B1 * 5/2001 Allen ..... A47G 9/0207 5/482

(Continued)

*Primary Examiner* — Basil S Katcheves
(74) *Attorney, Agent, or Firm* — Stoel Rives LLP

(57) ABSTRACT

Rigid wall shelters are used throughout the world for shipping, living quarters, and housing for electronic systems and are energy inefficient. While investigating energy-efficient technologies for rigid wall shelters the discovery was made to insulate the outside of the shelter rather than the inside. Space is often limited inside of the shelter. The invention of an external, re-deployable insulation system was developed. The present invention is an insulating system composed of three main components. The first component is multiple, flexible envelopes filled with insulating materials (which creates a panel). The second component is multiple insulating strips that cover the joint between the panels. The final component is a weatherproof outer covering that protects the entire system from the elements.

6 Claims, 10 Drawing Sheets

(56) References Cited

U.S. PATENT DOCUMENTS

| | | | | |
|---|---|---|---|---|
| 7,076,922 | B1 * | 7/2006 | Parres | E04B 1/8218 52/646 |
| 7,798,323 | B1 * | 9/2010 | McCann | A61F 17/00 206/370 |
| 8,572,911 | B1 * | 11/2013 | Binienda | E04H 15/20 52/202 |
| 9,074,793 | B1 * | 7/2015 | Baureis | A47C 7/748 |
| 10,954,057 | B2 * | 3/2021 | Waltermire | B65D 5/0065 |
| 2002/0133879 | A1 * | 9/2002 | Smith | A47G 9/086 5/413 R |
| 2002/0189730 | A1 * | 12/2002 | Garofalo | F17C 13/002 150/154 |
| 2003/0000517 | A1 * | 1/2003 | Joseph | B65D 81/3484 126/263.06 |
| 2009/0302023 | A1 * | 12/2009 | Caterina | H05B 3/267 219/386 |
| 2009/0302027 | A1 * | 12/2009 | Caterina | H05B 3/36 219/520 |
| 2016/0130800 | A1 * | 5/2016 | Williams | E04B 9/003 52/506.01 |
| 2017/0347621 | A1 * | 12/2017 | Jeddry | A01K 1/0157 |
| 2019/0032991 | A1 * | 1/2019 | Waltermire | F25D 23/06 |

* cited by examiner

MOBILE INSULATION SYSTEM

RELATED APPLICATION

This application claims the benefit of the earlier filing date of U.S. Provisional Application No. 62/902,477, filed on Sep. 19, 2019, and entitled MOBILE INSULATION SYSTEM, the entire contents of which is hereby incorporated by reference in its entirety.

FEDERALLY SPONSORED RESEARCH OR DEVELOPMENT

U.S. Army, Engineer Research and Development Center, Construction Engineering Research Laboratory, W9132T18C0009

TECHNICAL FIELD

The present disclosure relates generally devices used to insulate rigid wall structures. More specifically the present disclosure relates to devices used to provide a customizable insulative covering of rigid wall structures.

BRIEF DESCRIPTION OF THE DRAWINGS

The embodiments disclosed herein will become more fully apparent from the following description and appended claims, taken in conjunction with the accompanying drawings. These drawings depict only typical embodiments, which will be described with additional specificity and detail through use of the accompanying drawings in which:

DETAILED DESCRIPTION

Figure 1:
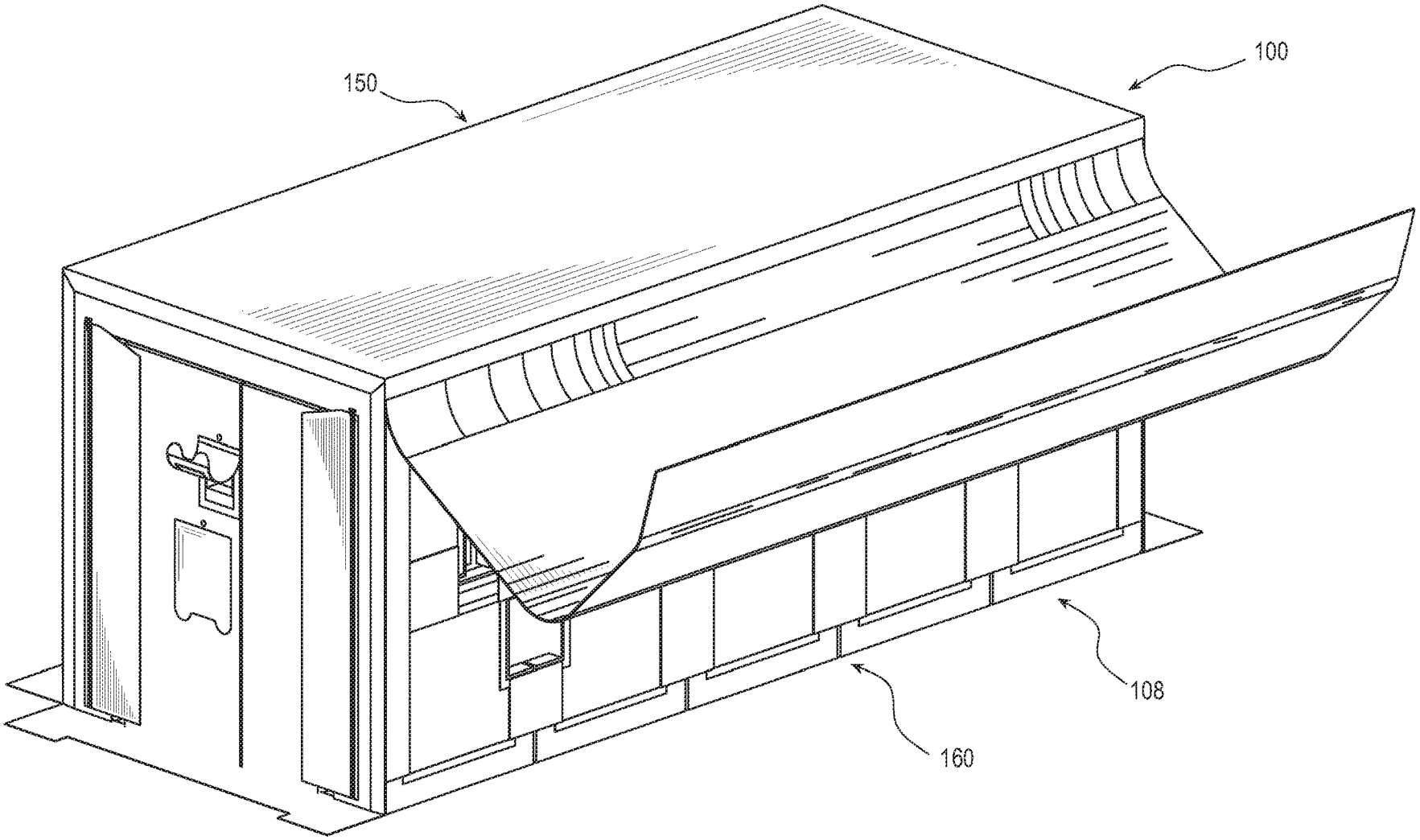
FIG. 1 is a perspective view of an embodiment of a mobile insulating system covering a rigid wall structure.

Rigid wall structures are used throughout the world for shipping, living quarters, and housing for electronic systems. In some embodiments the rigid wall structures are energy inefficient because they lack adequate insulation. In other embodiments, internal insulation is used to improve the energy efficiency of the rigid wall structures. The internal insulation occupies space within rigid wall structures, limiting storage, work, and living space.

The mobile insulating system of the present disclosure comprises an external insulating system composed of three main components. The first component is multiple, flexible envelopes filled with insulating materials (which creates a panel). The second component is multiple insulating strips that cover the joint between the panels. The final component is a weatherproof outer covering that protects the entire system from the elements.

Each envelope is made from a flexible weatherproof textile with attachment hardware along its perimeter as well as an outboard surface. The current iteration utilizes zippers along the perimeter and hook-and-loop fasteners on the outboard surface. The zippers are used to join additional panels creating arrays of the mobile insulating system. The hook-and-loop fastener on the outboard surface of the envelope is used to attach the insulating strips. Each envelope is filled with a weather-resistant insulating material, such as a closed cell polyethylene foam, but the design is not limited to this insulating material. The envelope allows a user to insert any material necessary to the end requirement post manufacturing.

The panels attach to the outside of the structure by form fitting over the structure and supporting their weight through strap attachment points. In some embodiments a cam strap and D-ring system are used to attach and adjust the insulating panels onto the structure.

In certain embodiments, insulating panels that move with the structure, for example, doors, are attached via magnets where possible. In the case of a structure composed of magnetic material, magnets are imbedded into the insulating panels and once the insulating panels are ready for installation the insulating panels are set in place and the magnetic field holds the insulating panels in place. In the case where the hard wall structure is not composed of a magnetic material, corrosion-resistant magnetic plates are bonded to an exterior surface of the hard wall structure where possible.

The insulating strips are made from a weatherproof textile that attaches to the external face of the panels via hook-and-loop fasteners. An insulating value is gained by adhering an insulating material to an inboard side of the strip that is positioned over a zipper seam when installed on the panel arrays. In some embodiments, a closed cell neoprene foam is used for the insulating material.

The terminology used herein is for the purpose of describing particular embodiments only and is not intended to be limiting of the invention. As used herein, the term "and/or" includes any and all combinations of one or more of the associated list items.

Embodiments may be understood by reference to the drawings, wherein like parts are designated by like numerals throughout. It will be readily understood by one of ordinary skill in the art having the benefit of this disclosure that the components of the embodiments, as generally described and illustrated in the figures herein, could be arranged and designed in a wide variety of different configurations. Thus, the following more detailed description of various embodiments, as represented in the figures, is not intended to limit the scope of the disclosure, but is merely representative of various embodiments. While the various aspects of the embodiments are presented in drawings, the drawings are not necessarily drawn to scale unless specifically indicated.

It will be appreciated that various features are sometimes grouped together in a single embodiment, figure, or description thereof for the purpose of streamlining the disclosure. Many of these features may be used alone and/or in combination with one another.

The phrases "coupled to" and "attached to" refer to any form of interaction between two or more entities, including mechanical, electrical, magnetic, electromagnetic, fluid, and thermal interaction. Two components may be coupled to or attached to each other even though they are not in direct contact with each other. For example, two components may be coupled to or attached to each other through an intermediate component.

Figure 2:
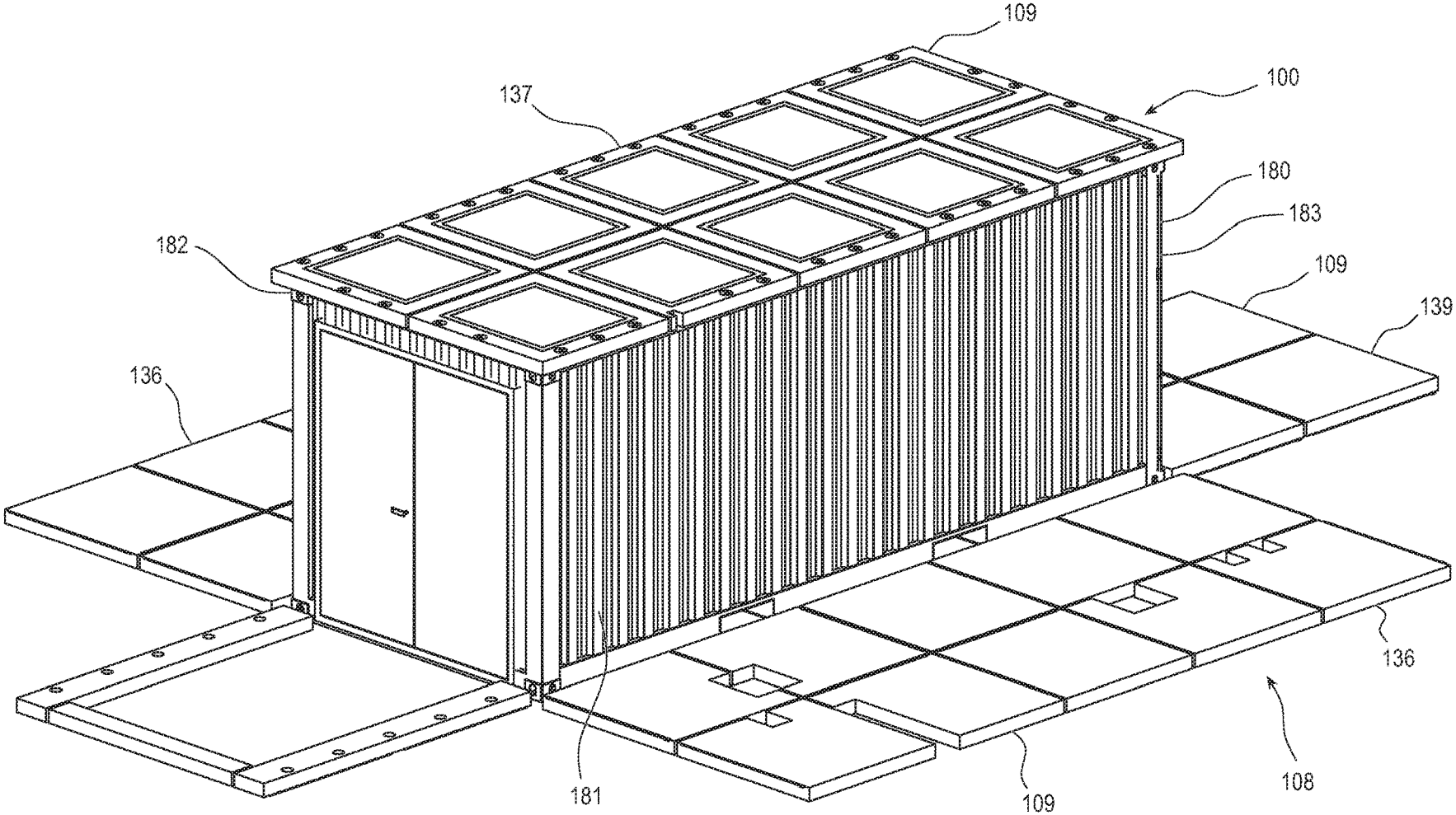
FIG. 2 is a perspective view of the mobile insulating system of FIG. 1 in an assembly state.
Figure 3:
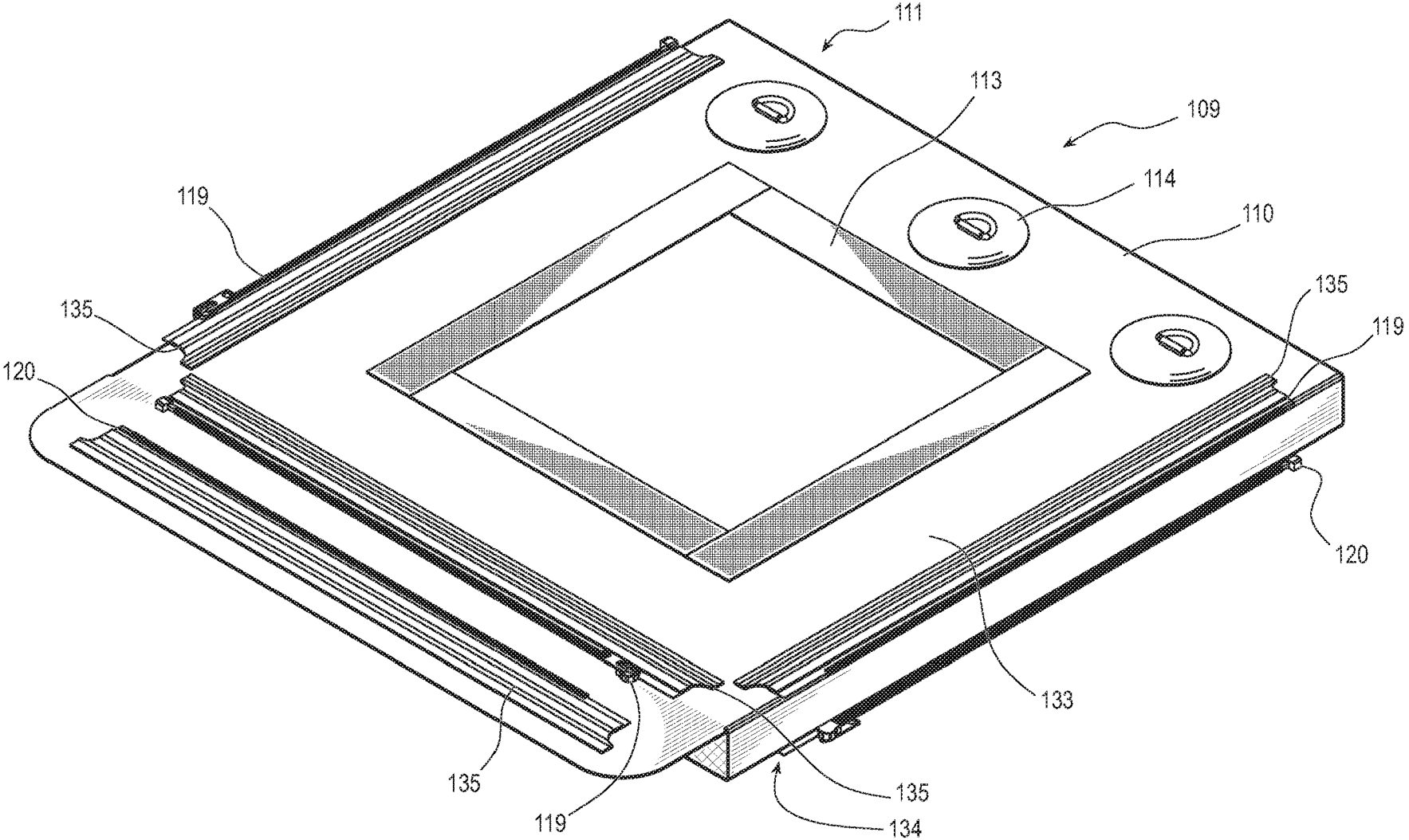
FIG. 3 is a perspective view of an embodiment of an insulating panel of the mobile insulating system of FIG. 1.
Figure 4:
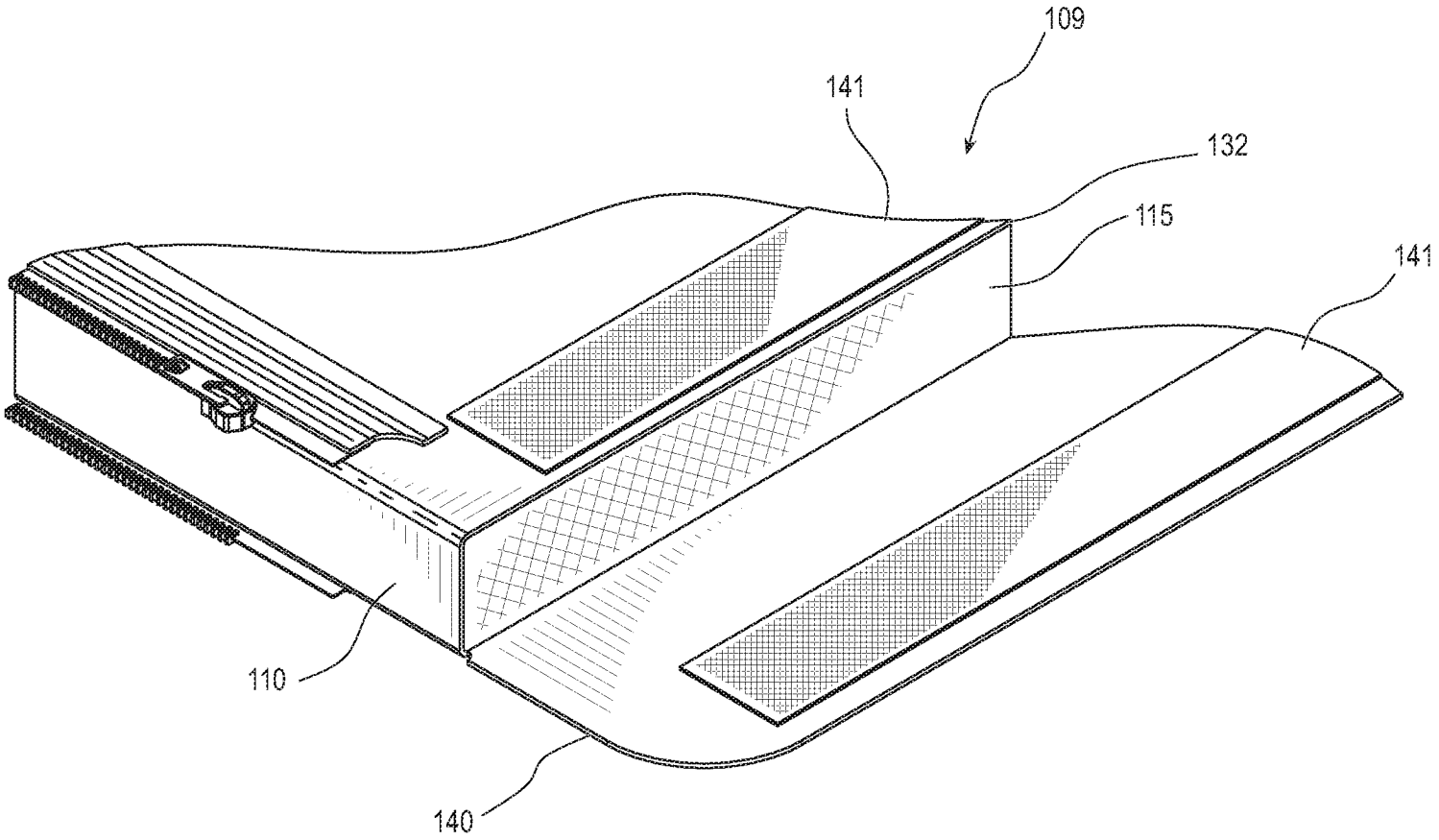
FIG. 4 is a perspective view of a portion of the insulating panel of FIG. 3.
Figure 5A:
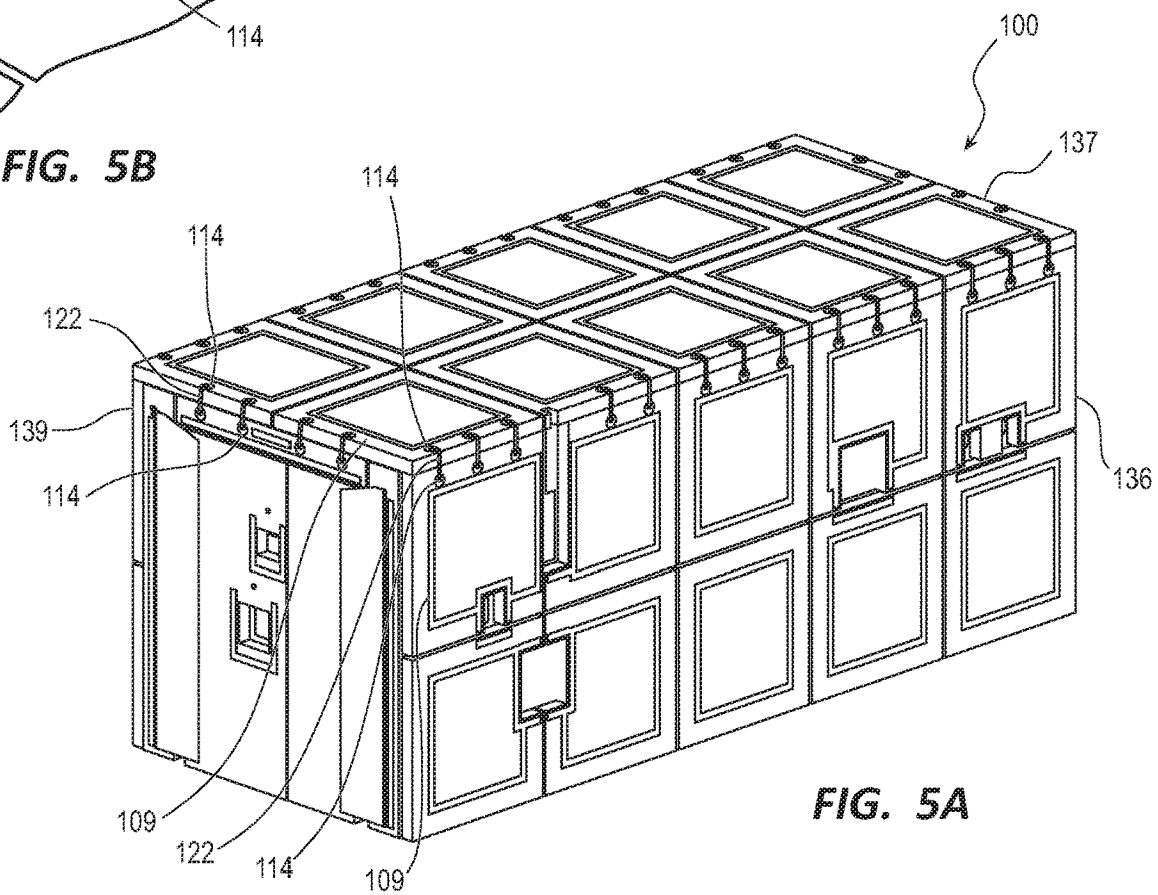
FIG. 5A is a perspective view of the mobile insulating system of FIG. 1 with straps disposed through fasteners of the insulating panel of FIG. 3.
Figure 5B:
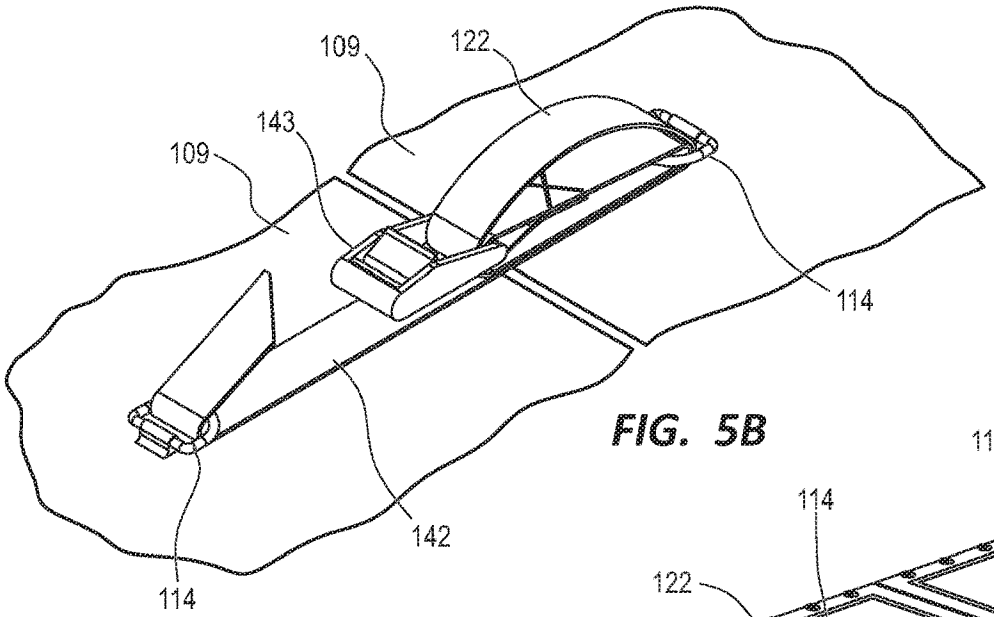
FIG. 5B is a perspective view of an embodiment of the strap of FIG. 5A.
Figure 6:
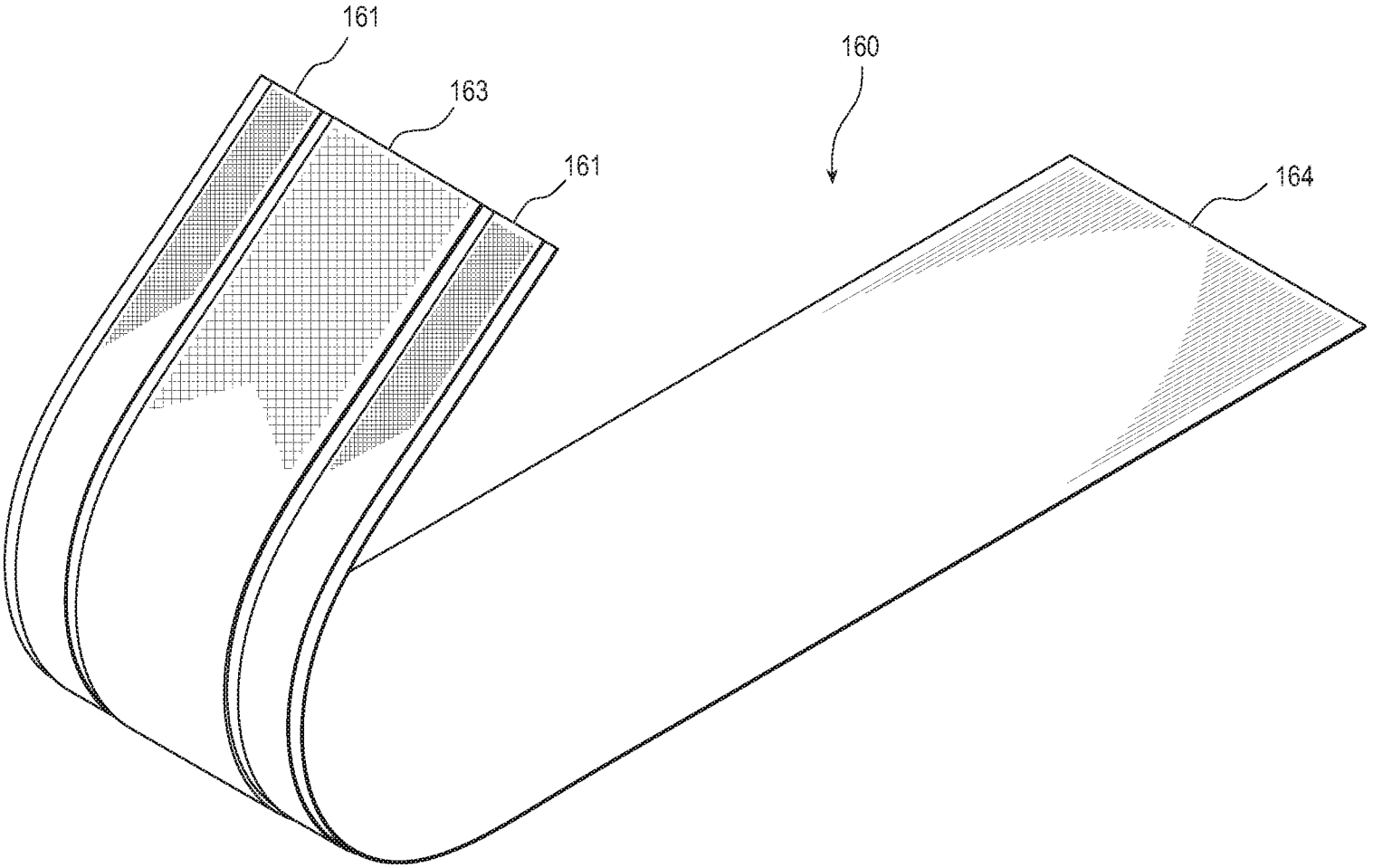
FIG. 6 is a perspective view of an insulating strip of the mobile insulating system of FIG. 1.
Figure 7:
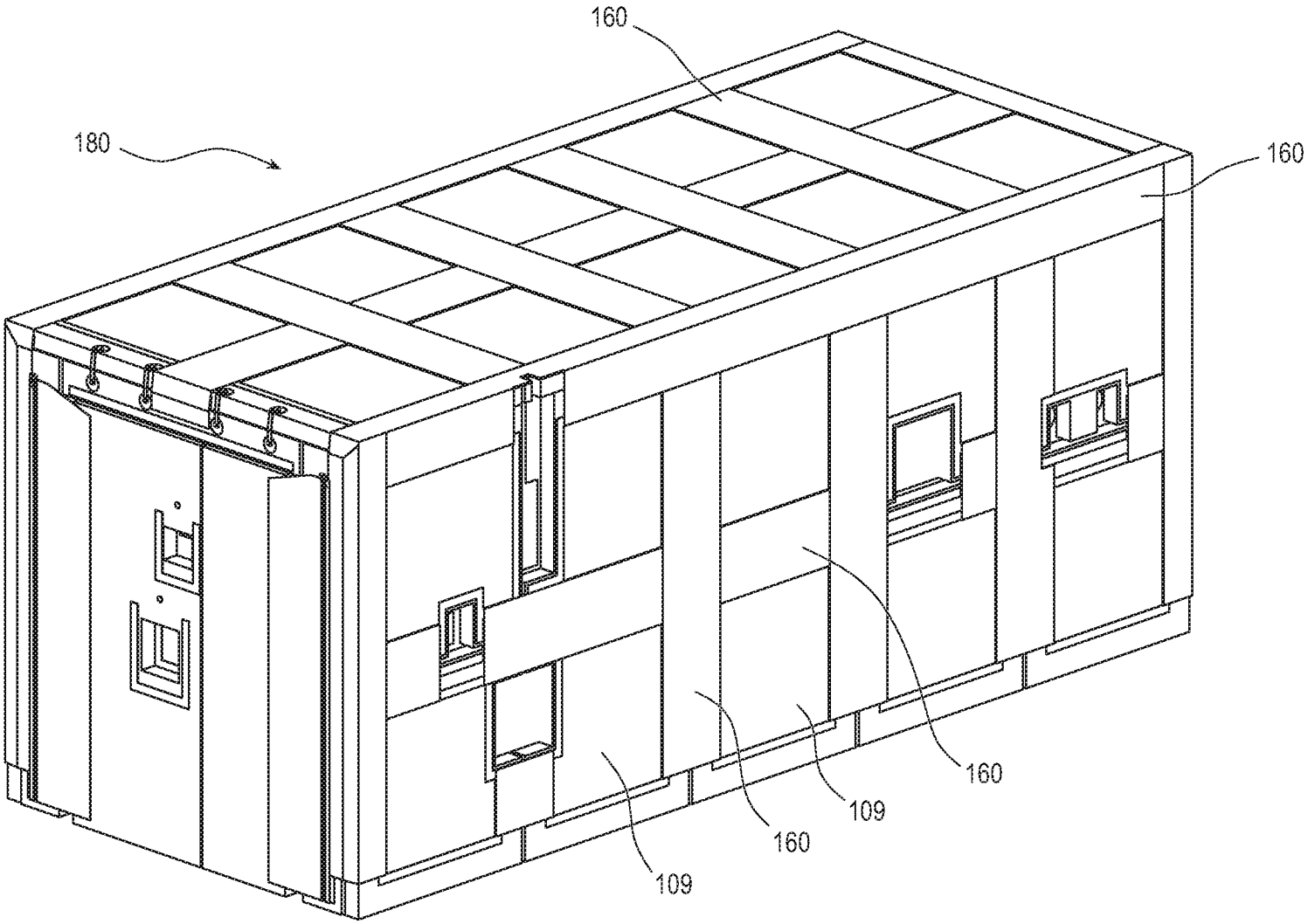
FIG. 7 is a perspective view of the mobile insulating system of FIG. 1 with access insulating panels.
Figure 8:
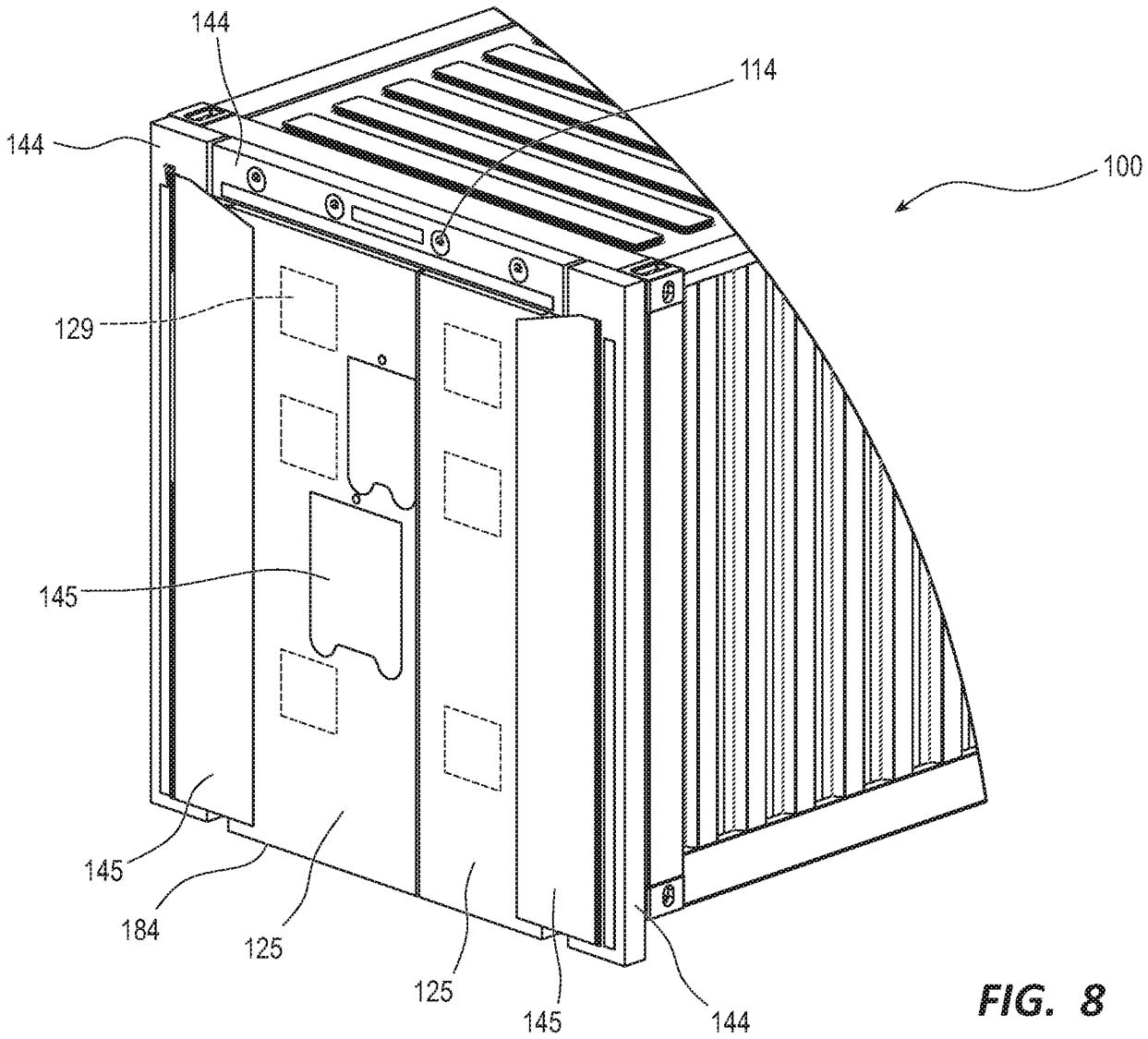
FIG. 8 is a perspective view of the access insulating panels of FIG. 7.
Figure 9:
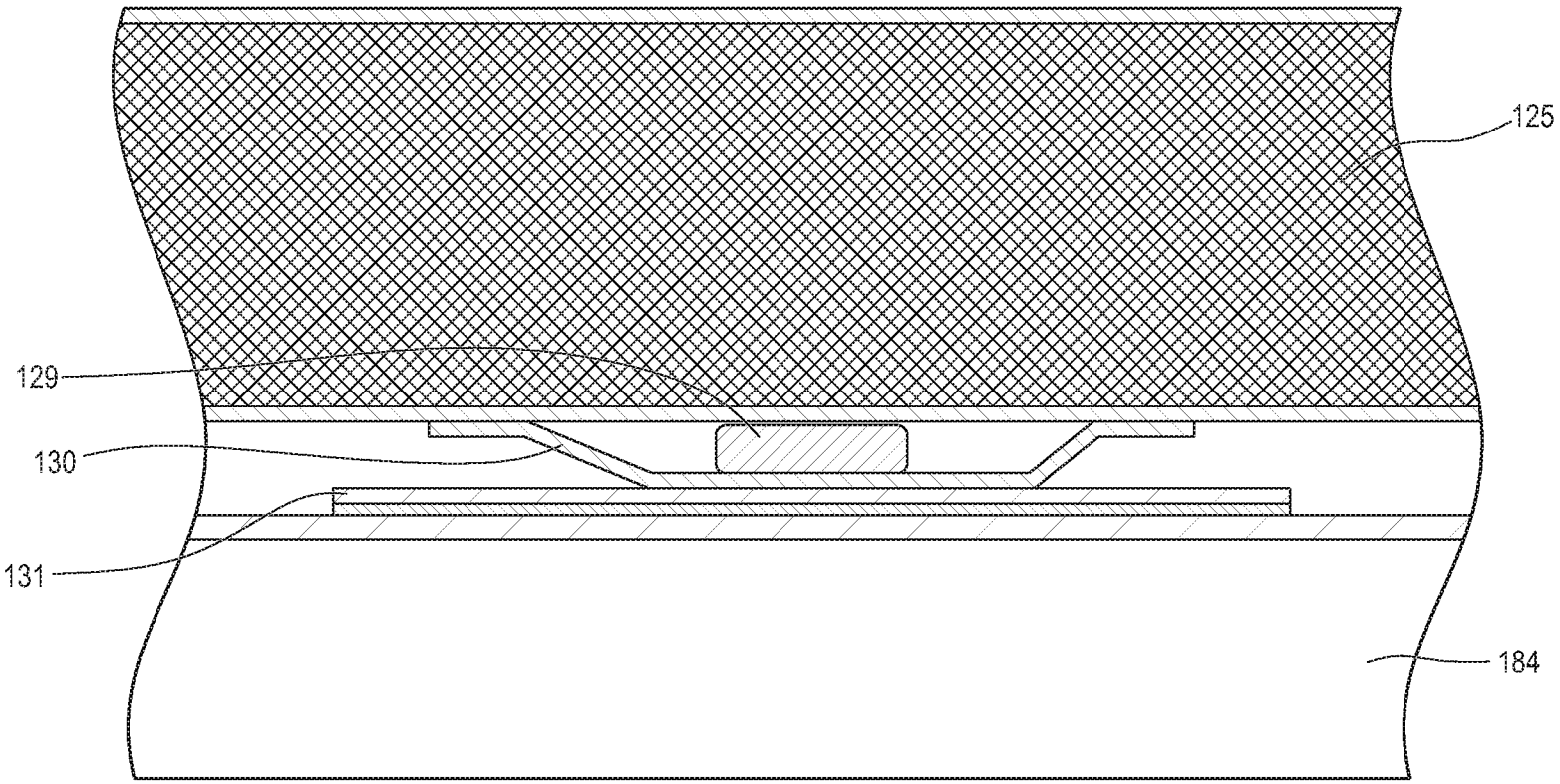
FIG. 9 is a cross-sectional view of the access insulating panel of FIG. 7 with a magnet and a magnetic plate.
Figure 10:
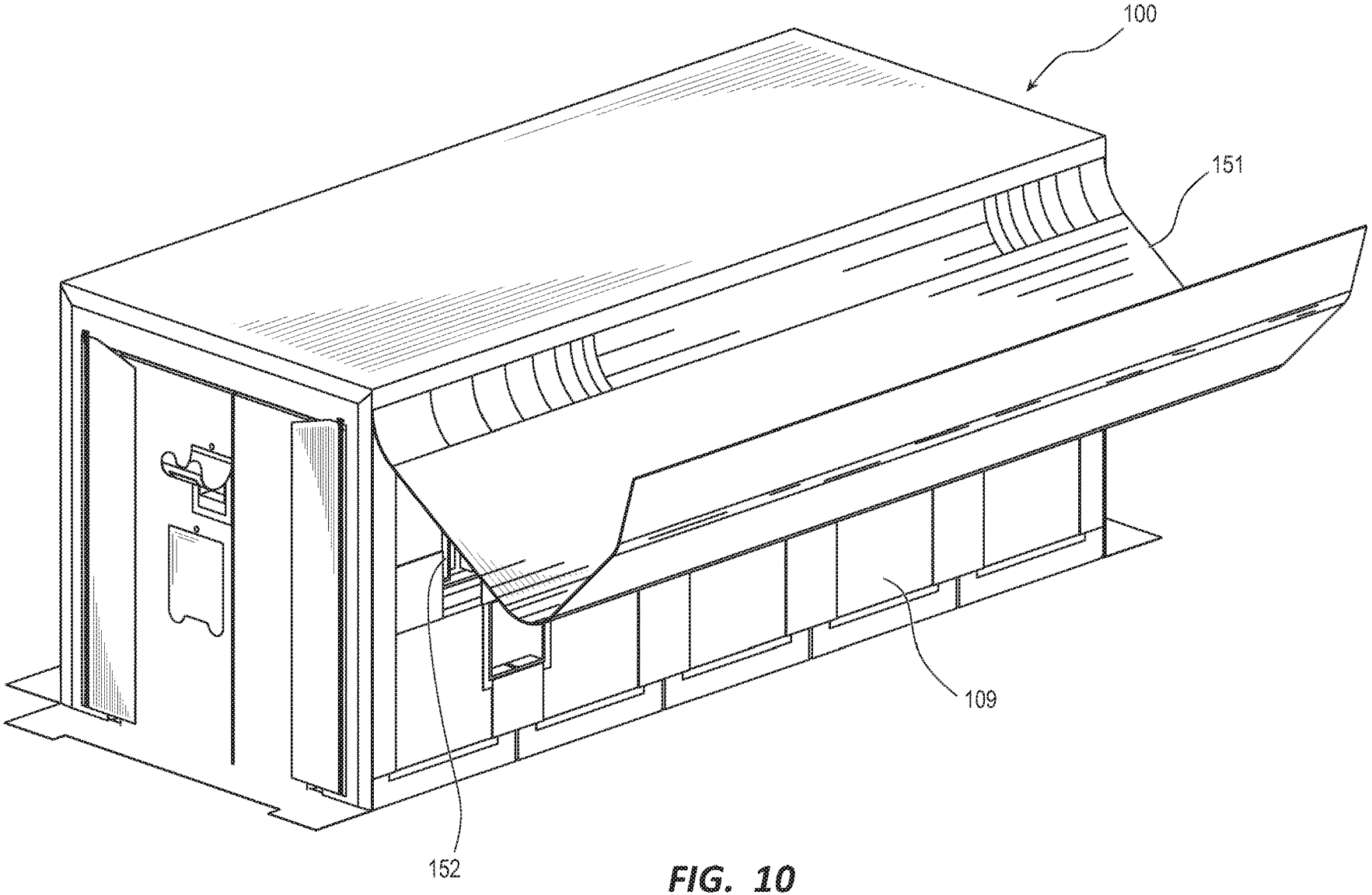
FIG. 10 is a perspective view of the mobile insulating system of FIG. 1 with an outer covering.

FIGS. 1-10 illustrate different views of several mobile insulating systems and related components. FIG. 1 is a perspective view of an embodiment of a mobile insulating system covering a rigid wall structure. FIG. 2 is a perspective view of the mobile insulating system of FIG. 1 in an assembly state. FIG. 3 is a perspective view of an embodiment of an insulating panel of the mobile insulating system of FIG. 1. FIG. 4 is a perspective view of a portion of the insulating panel of FIG. 3. FIG. 5A is a perspective view of the mobile insulating system of FIG. 1 with straps disposed through fasteners of the insulating panel of FIG. 3. FIG. 5B is a perspective view of an embodiment of the strap of FIG. 5A. FIG. 6 is a perspective view of an insulating strip of the mobile insulating system of FIG. 1. FIG. 7 is a perspective view of the mobile insulating system of FIG. 1 with access insulating panels. FIG. 8 is a perspective view of the access insulating panels of FIG. 7. FIG. 9 is a cross-sectional view of the access insulating panel of FIG. 7 with a magnet and a magnetic plate. FIG. 10 is a perspective view of the mobile insulating system of FIG. 1 with an outer covering. In certain views each system may be coupled to, or shown with, additional components not included in every view. Further, in some views only selected components are illustrated, to provide detail into the relationship of the components. Some components may be shown in multiple views, but not discussed in connection with every view. Disclosure provided in connection with any figure is relevant and applicable to disclosure provided in connection with any other figure or embodiment.

FIG. 1 depicts an embodiment of a mobile insulating system 100. In the illustrated embodiment, the mobile insulating system 100 includes three broad groups of components: insulating arrays 108, insulating strips 160, and an outer covering 150. The insulating arrays 108 can be configured to provide a primary level of protection, the insulating strips 160 can be configured to provide a secondary level of protection, and the outer covering 150 can be configured to provide a tertiary level of protection of the mobile insulating system 100.

FIG. 2 shows the insulating arrays 108. The insulating arrays 108 can include a plurality of insulating panels 109 that are coupled at edges of the insulating panels 109. Each insulating array 108 may be configured to cover an exposed surface of a rigid wall structure 180. For example, in the illustrated embodiment of FIG. 2, the mobile insulating system 100 can be include five insulating arrays 108 composed of 39 insulating panels 109 that cover five exposed surfaces of the rigid wall structure 180 (e.g., roof, two side walls, and two end walls). The insulating arrays 108 may include a wall array 136 configured to cover an exposed side wall 181, a roof array 137 configured to cover an exposed roof 182, and an end array 139 configured to cover an exposed end wall 183 of the rigid wall structure 180. In other embodiments, the number of insulating arrays 108 and insulating panels 109 may vary depending on the geometry and operational characteristics of the rigid wall structure 180 being covered. For example, the number of insulating arrays 108 may range from about three to about eight and the number of insulating panels 109 included in each insulating array 108 may range from about four to about 10.

FIG. 3 is a perspective view of an embodiment of the insulating panel 109. In the depicted embodiment, the insulating panel 109 may include an envelope 110 formed from a flexible weatherproof textile, such as fire-resistant polyvinyl chloride (PVC) material, nylon, polyester, etc., and includes stitched or welded seems. The insulating panel 109 may be square in shape and have a side length ranging from about 60 cm to about 250 cm and a thickness ranging from about eight cm to about twelve cm. In other embodiments, the envelope 110 may be of any other suitable shape, such as triangular, rectangular, pentagonal, hexagonal, etc. In still other embodiments, the envelope 110 can be uniquely shaped to fit a unique geometry of the rigid wall structure 180.

A perimeter of the insulating panel 109 may include an inboard zipper 119 attached to an inboard surface 133 (e.g., surface facing the rigid wall structure 180) and an outboard zipper 120 attached to an outboard surface 134 (e.g., surface facing away from the solid wall structure). The zippers 119, 120 can be attached to the insulating panels 109 by way of stitching the zippers 119, 120 to a precut strip 135 of material, such as fire-resistant PVC, and positioning the precut strip 135 in a specified location. The precut strip 135 may be attached to the envelope 110 using any suitable technique, such as thermal welding, stitching, adhesive bonding, etc. This method is done to allow precise positioning of the zippers 119, 120, in turn creating a tight seal between adjacent insulating panels 109 in an insulating array 108. When the insulating panels 109 are assembled into the insulating array 108, the inboard zipper 119 of a first insulating panel 109 may be coupled to the inboard zipper 119 of a second or adjacent insulating panel 109 and the outboard zipper 120 of the first insulating panel 109 may be coupled to the outboard zipper 120 of the second or adjacent insulating panel 109.

As illustrated in FIG. 3, attachment hardware 111 may be disposed on the outboard surface 134 of the envelope 110. The attachment hardware 111 can include a strip fastener 113 and a strap fastener 114. The strip fastener 113 can include a hook or loop portion of a hook-and-loop fastener and may be disposed in a pattern to facilitate fastening of an insulating strip 160 (shown in FIG. 6 and described below) to the insulating panels 109. The strip fastener 113 can be positioned in a way to allow full coverage of the joint between adjacent insulating panels 109 as well as coverage of the strip fastener 113 with the insulating strips 160. For example, in the depicted embodiment of FIG. 3, the strip fastener 113 may be disposed parallel to and a specified distance from each edge of the insulating panel 109. In other embodiments, the strip fastener 113 can be disposed in any other suitable pattern.

In the depicted embodiment of FIG. 3, the strap fastener 114 is shown to include stainless steel D-rings that can be bonded to the outboard surface 134 of the envelope 110. The D-rings, when used with cam straps 122 (shown in FIG. 5B and described below), are configured to attach the wall array 136 to the roof array 137, creating the primary insulating layer of the mobile insulating system 100.

FIG. 4 illustrates a portion of the insulating panel 109. As shown, insulation material 115 can be disposed within the envelope 110. In some embodiments, the insulation material 115 may be a 2 lb. closed cell polyethylene foam. In other embodiments, the insulation material 115 can include any suitable insulation material, such as closed cell neoprene foam, polyurethane foam, polystyrene foam, etc. The envelope 110 can include an open edge 132 that includes a closure flap 140. A fastener 141, such as a hook-and-loop fastener, may be disposed along the open edge 132 and the closure flap 140 to close or seal the open edge 132. In some embodiments, the open edge 132 may be disposed along a lowermost edge of the envelope 110 to reduce the likelihood of moisture buildup within the envelope 110. In other embodiments, the open edge 132 can be disposed along any other edge of the envelope 110, such as a side edge or a top edge. In certain embodiments, a ballistic panel may be disposed within the envelope 110 to provide ballistic protection for the rigid wall structure 180. For example, the ballistic panel may be formed of any suitable material, such as polycarbonate, para-aramids, high-molecular weight polyethylene, carbon fiber composites, steel, titanium, artificial silk, etc.

FIG. 5A depicts the insulating panels 109 of the roof array 137 attached to the wall array 136 and the end array 139 using the cam straps 122 and strap fasteners 114 (e.g., D-rings) of the insulating panels 109 of the mobile insulating system 100. As shown, the wall and end arrays 136, 139 can be suspended or hung from the roof array 137.

FIG. 5B depicts an embodiment of the cam strap 122. As illustrated, the cam strap 122 can include a strap 142 and a buckle 143. The strap 142 may be formed of any suitable material, such as a nylon woven, polyester, polypropylene, etc. The buckle 143 can be of any suitable type configured to facilitate tightening of the strap 142 between the strap fasteners 114. For example, the buckle 143 may be a cam buckle, ratchet buckle, side release buckle, quick release buckle, etc. As shown in FIG. 5B, the cam strap 122 may be coupled to the strap fasteners 114 by passing the strap 142 through the strap fasteners 114 and tightening the buckle 143 to minimize a gap between the adjacent insulating panels 109.

FIG. 6 illustrates an embodiment of the insulating strip 160. As depicted in the embodiment of FIG. 6, the insulating strip 160 can include a flexible strip 164, a fastener 161, and a flexible insulating material 163. The flexible strip 164 may be formed of PVC material. In other embodiments, the flexible strip 164 can be formed of any other suitable material, such as polyurethane, polyethylene, polystyrene, etc. The fastener 161 may be disposed along longitudinal edges on a back surface of the flexible strip 164. The fastener 161 of the depicted embodiment can be a hook or loop portion of the hook-and-loop fastener configured to couple to the strip fastener 113 disposed on the insulating panel 109, as previously discussed. For example, the strip fastener 113 may include the hook portion of the hook-and-loop fastener and the fastener 161 may include the loop portion of the hook-and-loop fastener. An opposite configuration is also within a scope of this disclosure. The flexible insulating material 163 can be disposed on the back surface to the flexible strip 164 between the fasteners 161. The flexible insulating material 163 may be formed of any suitable material, such as closed cell neoprene foam, polyethylene foam, polyurethane foam, polystyrene foam, etc.

FIG. 7 depicts the insulating strips 160 coupled to the insulating panels 109 to cover gaps between adjacent insulating panels 109 to prevent air, such as hot or cold air, from passing through the gaps and surrounding external surfaces of the rigid wall structure 180. When hot or cold air surrounds the rigid wall structure 180, energy may be required to either cool or heat an internal space of the rigid wall structure 180 to maintain a suitable environment for living, storage, or function of electronics.

FIG. 8 depicts access insulating panels 125 and frame insulating panels 144 of the mobile insulating system 100. The access insulating panels 125 and the frame insulating panels 144 may be used at any moveable location of the rigid wall structure 180. For example, the access insulating panels 125 and the frame insulating panels 144 can be used to cover an access door. As depicted in FIG. 8, the access insulating panels 125 and the frame insulating panels 144 are shown to be covering an access including double doors 184 of the rigid wall structure 180. The access insulating panels 125 may overlap a gap between each door of the double doors 184. The frame insulating panels 144 may surround the access insulating panels 125. Flexible side flaps 145 can be coupled to the frame insulating panels 144 to cover gaps between the access insulating panels 125 and the frame insulating panels 144. The flexible side flaps 145 can be coupled to the frame insulating panels 144 using any suitable technique, such as a zipper, hook-and-loop fastener, etc.

In certain embodiments, the access insulating panels 125 and the frame insulating panels 144 can be attached to the rigid wall structure 180 using high-strength magnets 129 configured to magnetically attach to the rigid wall structure 180 formed of a ferromagnetic material. As shown in FIG. 9, the magnet 129 may be disposed in a closed pouch 130 disposed on the inboard surface 133 of the access and frame insulating panels 125, 144. In some instances, the rigid wall structure 180 may not be formed from a non-ferromagnetic material. In this configuration, a corrosion-resistant, ferromagnetic plate 131 may be attached to the rigid wall structure 180 using any suitable technique, such as bonding, fasteners, etc. This configuration enables a functionality of a magnetic attachment system but does not require significant modification to the rigid wall structure 180.

FIG. 10 illustrates an outer covering 150 of the mobile insulating system 100. The outer covering 150 is configured to further prevent energy transfer by providing a weatherproof cover around mobile insulating system 100. As depicted, the outer covering 150 can include a membrane 151 and covering fasteners 152. The outer covering 150 may be sized to snugly fit over the rigid wall structure 180 with the insulating panels 109 installed. The membrane 151 may be composed of a flexible textile, such as ripstop nylon, polyester, canvas, etc. In some embodiments, the textile may be coated with a weatherproof material such as PVC, polyethylene, polyurethane, silicone elastomer, silicone oil, fluoropolymer, wax, linseed oil, etc. The covering fasteners 152 can be attached to the membrane 151 and disposed at each corner of the outer covering 150. The covering fasteners 152 can be of any suitable type, such as zipper, hook-and-loop fastener, strap and buckle, buttons, snaps, etc. After the outer covering 150 is positioned correctly over the rigid wall structure 180, the corners can be closed to enclose the rigid wall structure 180.

In certain embodiments as illustrated in FIG. 10, the outer covering 150 can include a folding flap 153 disposed at each location where the outer covering 150 is penetrated. The folding flap 153 may have a unique configuration that can assist a user in the operation of the folding flap 153 during inclement weather conditions without requiring removal of a protective garment. For example, the folding flap 153 may include a side release buckle, quick release buckle, hook-and-loop fastener, etc. The folding flap 153 can utilize the same type of flexible insulating material 163 and strip fastener 161 as the insulating strips 160, as previously discussed.

In other embodiments, the membrane 151 of the outer covering 150 may be printed to meet certain concealment requirements. The printing may include a military operational camouflage pattern (OCP), a log cabin, foliage, boulders, sand color, etc. or any other pattern or color desired by a user.

In some embodiments, the membrane 151 of the outer covering 150 can include a material to block electromagnetic interference (EMI) from entering the rigid wall structure 180. In other words, the outer covering 150 may form a Faraday cage when disposed around the rigid wall structure 180. In one embodiment, a metalized conductive fabric or foil can be coupled to an underside of the membrane 151. In another embodiment, metal particles or wires may be embedded in the membrane 151.

In some embodiments, the mobile insulating system 100 may not require permanent modification of the rigid wall structure 180 to complete installation. In other embodiments, the mobile insulating system 100 may not decrease the internal volume of the rigid wall structure 180. In another embodiment, the mobile insulating system 100 may provide ballistic protection to the rigid wall structure 180. In still other embodiments, the mobile insulating system 100 can provide sound protection to the rigid wall structure 180. In yet another embodiment, the mobile insulating system 100 may provide protection against EMI.

Any methods disclosed herein comprise one or more steps or actions for performing the described method. The method steps and/or actions may be interchanged with one another. In other words, unless a specific order of steps or actions is required for proper operation of the embodiment, the order and/or use of specific steps and/or actions may be modified. For example, a method of insulating a rigid wall structure may comprise the steps of: covering at least a portion of the rigid wall structure with a plurality of insulating panels; coupling adjacent panels of the plurality of insulating panels with an insulating strip; and covering the rigid wall structure and the insulating panels with a weatherproof outer covering.

Embodiments may be understood by reference to the drawings, wherein like parts are designated by like numerals throughout. It will be readily understood by one of ordinary skill in the art having the benefit of this disclosure that the components of the embodiments, as generally described and illustrated in the figures herein, could be arranged and designed in a wide variety of different configurations. Thus, the following more detailed description of various embodiments, as represented in the figures, is not intended to limit the scope of the disclosure, but is merely representative of various embodiments. While the various aspects of the embodiments are presented in drawings, the drawings are not necessarily drawn to scale unless specifically indicated.

Reference throughout this specification to "an embodiment" or "the embodiment" means that a particular feature, structure, or characteristic described in connection with that embodiment is included in at least one embodiment. Thus, the quoted phrases, or variations thereof, as recited throughout this specification are not necessarily all referring to the same embodiment.

Similarly, in the above description of embodiments, various features are sometimes grouped together in a single embodiment, figure, or description thereof for the purpose of streamlining the disclosure. This method of disclosure, however, is not to be interpreted as reflecting an intention that any claim requires more features than those expressly recited in that claim. Rather, as the following claims reflect, inventive aspects lie in a combination of fewer than all features of any single foregoing disclosed embodiment.

It will be appreciated that various features are sometimes grouped together in a single embodiment, figure, or description thereof for the purpose of streamlining the disclosure. Many of these features may be used alone and/or in combination with one another.

The phrases "coupled to" and "attached to" refer to any form of interaction between two or more entities, including mechanical, electrical, magnetic, electromagnetic, fluid, and thermal interaction. Two components may be coupled to or attached to each other even though they are not in direct contact with each other. For example, two components may be coupled to or attached to with each other through an intermediate component.

References to approximations are made throughout this specification, such as by use of the term "substantially." For each such reference, it is to be understood that, in some embodiments, the value, feature, or characteristic may be specified without approximation. For example, where qualifiers such as "about" and "substantially" are used, these terms include within their scope the qualified words in the absence of their qualifiers. For example, where the term "substantially perpendicular" is recited with respect to a feature, it is understood that in further embodiments, the feature can have a precisely perpendicular configuration.

The terms "a" and "an" can be described as one, but not limited to one. For example, although the disclosure may recite a housing having "a stopper," the disclosure also contemplates that the housing can have two or more stoppers.

Unless otherwise stated, all ranges include both endpoints and all numbers between the endpoints.

Recitation in the claims of the term "first" with respect to a feature or element does not necessarily imply the existence of a second or additional such feature or element. Elements recited in means-plus-function format are intended to be construed in accordance with 35 U.S.C. § 112 ¶6. It will be apparent to those having skill in the art that changes may be made to the details of the above-described embodiments without departing from the underlying principles of the invention. Embodiments of the invention in which an exclusive property or privilege is claimed are defined as follows.

The claims following this written disclosure are hereby expressly incorporated into the present written disclosure, with each claim standing on its own as a separate embodiment. This disclosure includes all permutations of the independent claims with their dependent claims. Moreover, additional embodiments capable of derivation from the independent and dependent claims that follow are also expressly incorporated into the present written description.

Without further elaboration, it is believed that one skilled in the art can use the preceding description to utilize the invention to its fullest extent. The claims and embodiments disclosed herein are to be construed as merely illustrative and exemplary, and not a limitation of the scope of the present disclosure in any way. It will be apparent to those having ordinary skill in the art, with the aid of the present disclosure, that changes may be made to the details of the above-described embodiments without departing from the underlying principles of the disclosure herein. In other words, various modifications and improvements of the embodiments specifically disclosed in the description above are within the scope of the appended claims. Moreover, the order of the steps or actions of the methods disclosed herein may be changed by those skilled in the art without departing from the scope of the present disclosure. In other words, unless a specific order of steps or actions is required for proper operation of the embodiment, the order or use of specific steps or actions may be modified. The scope of the invention is therefore defined by the following claims and their equivalents.

The invention claimed is:

1. An insulation panel, comprising:

a flexible envelope;

an insulating material disposed within the envelope;

a first zipper disposed on an outboard perimeter of the envelope and configured to couple with a zipper disposed on an outboard perimeter of a first insulation panel disposed adjacent the insulation panel;

a second zipper disposed on an inboard perimeter of the envelope and configured to couple with a zipper disposed on an inboard perimeter of a second insulation panel disposed adjacent the insulation panel;

a strap fastener disposed on the outboard surface of the envelope; and a panel fastener disposed on the outboard surface of the envelope.

2. The insulation panel of claim 1, wherein the insulating material comprises any one of closed cell polyethylene foam, polyurethane foam, polystyrene foam, and any combination thereof.

3. The insulation panel of claim 1, wherein the strap fastener comprises a D-ring.

4. The insulation panel of claim 1, wherein the panel fastener comprises a hook-and-loop fastener.

5. The insulation panel of claim 1, further comprising a static magnet disposed on the inboard surface of the panel.

6. The insulation panel of claim 5, further comprising a pouch disposed on the inboard surface of the panel and configured to receive the static magnet.

* * * * *